US006254252B1

(12) United States Patent
Coushaine et al.

(10) Patent No.: US 6,254,252 B1
(45) Date of Patent: Jul. 3, 2001

(54) LAMP AND LAMP BASE ASSEMBLY

(75) Inventors: Charles M. Coushaine, Rindge; James P. Szep, Peterborough, both of NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/312,297

(22) Filed: May 14, 1999

(51) Int. Cl.[7] ..... F21V 21/00; H01K 1/00

(52) U.S. Cl. ..... 362/226; 362/382; 362/519; 315/58; 439/611; 439/699.2; 439/236; 439/602

(58) Field of Search ..... 362/382, 226, 362/306, 519, 514, 516, 548, 549; 439/611, 699.2, 236, 602, 619, 645, 646, 226, 617; 315/56, 57, 58

(56) References Cited

U.S. PATENT DOCUMENTS

| | | | | |
|---|---|---|---|---|
| 3,701,081 | * | 10/1972 | Jayne et al. | 439/611 |
| 3,963,916 | * | 6/1976 | Morton | 439/611 |
| 4,263,823 | * | 4/1981 | Engel | 315/58 |
| 4,495,443 | * | 1/1985 | Cummings | 315/58 |
| 4,822,302 | | 4/1989 | Dorleans | 439/544 |
| 4,935,852 | * | 6/1990 | Hsu | 362/226 |
| 4,975,813 | * | 12/1990 | Chen | 362/226 |
| 5,463,270 | * | 10/1995 | Wakimizk et al. | 439/611 |
| 5,569,981 | * | 10/1996 | Cho | 439/602 |
| 5,626,415 | * | 5/1997 | Huang | 362/226 |
| 5,696,424 | | 12/1997 | Coushaine | 313/318.1 |
| 5,720,548 | * | 2/1998 | Geary | 362/226 X |
| 5,864,461 | * | 1/1999 | Cho | 315/58 |
| 6,022,241 | * | 2/2000 | Lin | 362/226 X |
| 6,030,095 | * | 2/2000 | Moore, et al. | 362/226 |
| 6,080,019 | | 6/2000 | Coushaine | 439/611 |
| 6,123,433 | * | 9/2000 | Chen | 362/226 |

* cited by examiner

*Primary Examiner*—Laura K. Tso
(74) *Attorney, Agent, or Firm*—William E. Meyer

(57) ABSTRACT

A first lamp base assembly is provided which includes two separate base components. The first base component is attachable to a lamp via a lamp retainer and to the second base component. The second base component is attachable to the first base component and to a connector. The second base component may be a straight base component or an angled base component. Since either one of the second base components may be attached to the first base component, an adjustable lamp base assembly is provided which may be assembled as a straight or an angled lamp base. A second lamp base assembly is provided which includes a base which is attachable to a connector and one of various differently configured lamp attachment members, such attachment members being adapted to be attachable to a lamp via a lamp retainer. Since various lamp attachment members may be attached to the base, an adjustable lamp base assembly is provided which may be adapted for use with different lamps. The first and second lamp base assemblies may be combined to combine the adjustable features of each. A lamp including the foregoing lamp base assemblies is also provided.

26 Claims, 9 Drawing Sheets

LAMP AND LAMP BASE ASSEMBLY

TECHNICAL FIELD

The present invention relates to a lamp base assembly, and more particularly, to an adjustable lamp base assembly which may be adapted for use as a straight or an angled lamp base. A lamp base assembly is also provided which may be adapted for coupling thereto any one of a plurality of differently configured lamps. The advantages of the two lamp base assemblies may be combined to combine the adjustable features of each. A lamp including such lamp base assemblies is also provided.

BACKGROUND ART

It is known to provide lamp assemblies which generally include a lamp coupled to a lamp base assembly. Typically, such a lamp base assembly includes a one piece base which has either a straight base design or an angled base design, such as a right angle base. In a straight base design, such as the type typically used in automotive headlamps in the United States, the base extends in a direction of the lamp axis. In a right angle base, such as the type typically used in automotive headlamps in Europe, the base includes a connector segment which extends at a right angle relative to the lamp axis. In addition to the existence of straight and angled bases, lamp base assemblies are designed for use with a specific type of lamp. In particular, each lamp design will typically require a specific mounting structure at the lamp base assembly to which the lamp is to be coupled.

It is costly for lamp manufacturers to produce and inventory such various alternative lamp bases. For example, heretofore it has been necessary to produce and inventory straight lamp bases and ninety degree lamp bases as well as different lamp bases for use with different types of lamps. In addition, lamp bases heretofore produced have typically been fabricated from a material designed to withstand the temperature of the lamp with which the base is to be used. One problem associated with this requirement is that lamps having very high temperatures typically require the use of more expensive high temperature plastic material. Other expenses incurred due to the need to provide a large range of base types relate to the need to provide multiple types of equipment, and multiple processing techniques, having various specifications.

In addition to the foregoing, the designs of lamp base assemblies heretofore provided inherently have very cramped physical features which cause undesirable space constraints. Such constraints provide difficulties when focusing a lamp being attached to the lamp base assembly. In some designs, such focusing problems result from the orientation of the welds during, for example, laser welding of the lamp leads to the contacts located within the lamp base.

DISCLOSURE OF THE INVENTION

It is an object of the present invention to provide an improved lamp base assembly for use with a lamp.

Another object of the present invention is to obviate the disadvantages of the prior art by providing an adjustable lamp base assembly.

A further object of the present invention is to provide an improved and cost efficient lamp base assembly.

Yet another object of the present invention is to provide a lamp base assembly which may be readily adjusted between a straight lamp base and an angled lamp base.

Another object of the present invention is to provide a lamp base assembly which may be readily adjusted for use with one of a plurality of differently configured lamps.

A further object of the present invention is to provide a lamp base assembly wherein a base component nearest the lamp may be fabricated from a high temperature material and another base component containing the lamp connector may be fabricated from a low temperature material.

Yet another object of the present invention is to provide a lamp base assembly which may be fabricated from various interchangeable parts to meet various lamp assembly requirements.

Another object of the present invention is to provide a lamp base assembly which provides improved focusing features.

A further object of the present invention is to provide a lamp which fulfills one or more of the foregoing objects.

The present invention achieves these and other objects by providing a lamp base assembly which comprises separate first and second base components attached together. The first base component comprises a first portion structured and arranged for attachment to a lamp and an opposite second portion structured and arranged for attachment to the second base component. The separate second base component comprises a third portion structured and arranged for attachment to the second portion and a fourth portion comprising contacts structured and arranged for mechanical and electrical connection with (a) lead wires of the lamp and (b) a connector. The second base component may be a straight base component or an angled base component.

A lamp base assembly is also provided which comprises a base having contacts therein structured and arranged for mechanical and electrical connection with (a) lead wires of a lamp and (b) a connector. The base includes a base mounting portion structured and arranged for attachment to any one of a plurality of differently configured lamp attachment members. Each lamp attachment member includes one portion attachable to the base mounting portion and another portion attachable to a lamp retainer. The base of such lamp base assembly may include separate first and second base components attached together, the second base component being a straight base design or an angled base design.

A lamp including each lamp base assembly of the present invention is also provided.

BRIEF DESCRIPTION OF THE DRAWINGS

This invention may be clearly understood by reference to the attached drawings in which like reference numerals designate like parts and in which.

MODE FOR CARRYING OUT THE INVENTION

Figure 1:
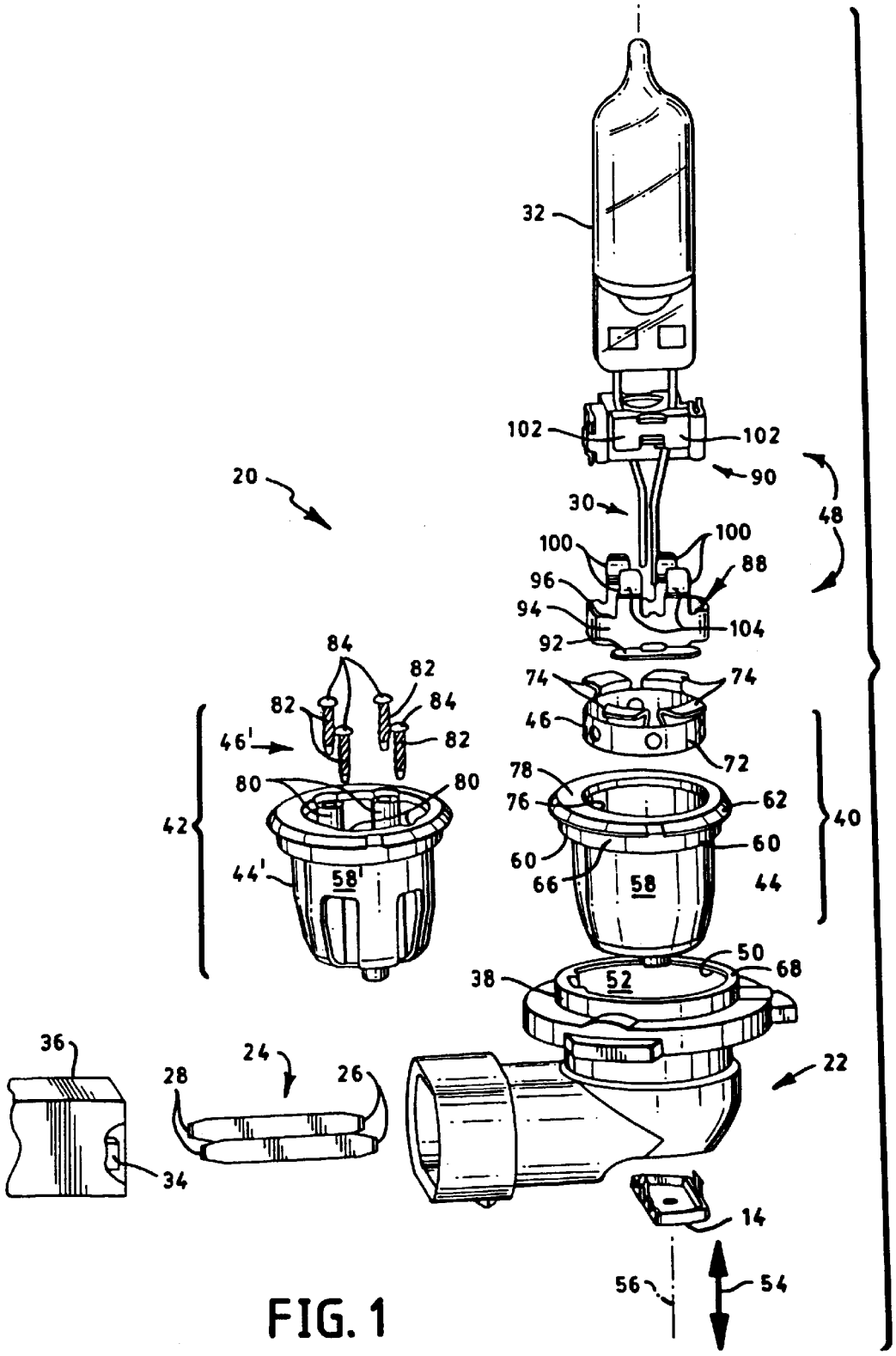
FIG. 1 is an exploded perspective view of one embodiment of the present invention illustrating two alternative lamp base assemblies.

For a better understanding of the present invention, together with other and further objects, advantages and capabilities thereof, reference is made to the following disclosure and appended claims taken in conjunction with the above-described drawings.

The lamp base assembly of the present invention includes a base which comprises a base mounting portion structured and arranged for attachment to any one of a plurality of differently configured attachment members. For example, in the embodiment illustrated in FIG. 1, a lamp base assembly 20 is provided which comprises a base 22 having contacts 24 therein. Contacts 24 include respective ends 26 and 28. Contacts 24 are structured and arranged for mechanical and electrical connection of ends 26 with lead wires 30 of a lamp 32 when the lamp is coupled to the lamp base assembly 20. Contacts 24 are also structured and arranged for mechanical and electrical connection of ends 28 with contacts 34 of a mating connector 36 in a conventional manner. The base 22 of the lamp base assembly 20 includes a base mounting portion 38 which is structured and arranged for attachment to attachment member or nose 40 or alternatively to attachment member or nose 42. In the embodiment illustrated in FIG. 1, the attachment members 40 and 42 provide two different structural configurations either one of which may be attached to the base 22. The base 22 may include a sealing cover 14.

In the embodiment illustrated in FIG. 1, the attachment members 40 and 42 each comprises a respective cup-shaped element 44, 44' attachable to the base mounting portion 38, and a respective mounting element 46, 46' attachable to a lamp retainer 48. The base mounting portion 38 includes a recess 50 which comprises a substantially cylindrical inner wall 52 which extends in the direction 54 of a base axis 56.

Figure 2:
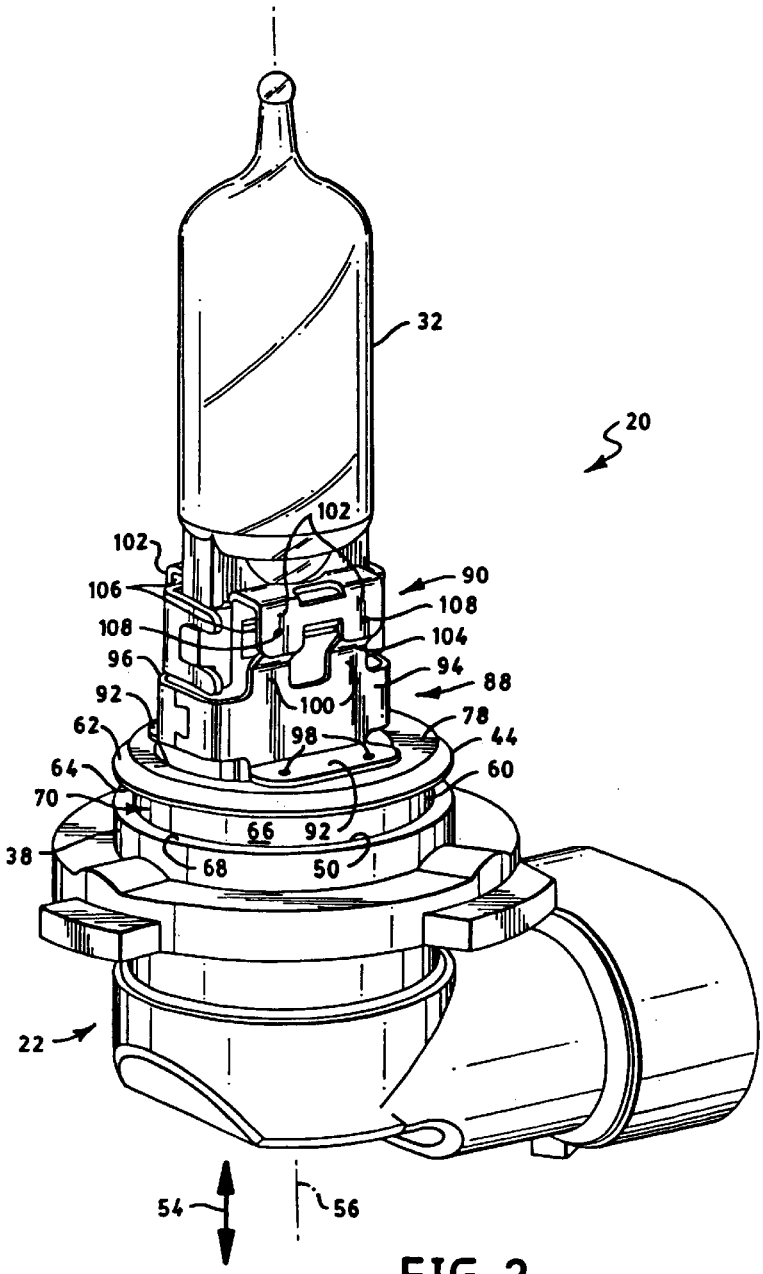
FIG. 2 is a perspective view of one lamp base assembly of FIG. 1.
Figure 2:
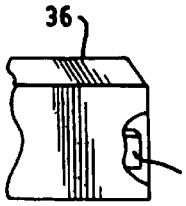

In the embodiment illustrated in FIGS. 1 and 2, the cup-shaped element 44 may be fabricated from a high temperature plastic material such as Amoco Amodel 1145, and the base 22 may be fabricated from a low temperature plastic material such as valox 425. Element 44 comprises an outer peripheral partially cylindrical surface 58. The element 44 also includes a flange 60 having a diameter greater than the diameter of the partially cylindrical surface 58, and a flange 62 having a diameter greater than the diameter of flange 60. In assembling the lamp base assembly 20, the element 44 is inserted into the recess 50 until the flange 60 engages the base mounting portion 38 as illustrated in FIG. 2. Essentially, the surface 58 will mate with and engage the inner wall 52 of the recess 50. As will be apparent from FIG. 2, the surface 64 of the flange 62, the outer peripheral surface 66 of the flange 60 and the surface 68 of the base mounting portion 38 will form a groove 70 into which a gasket, O-ring and the like (not shown) may be inserted to provide a seal for use with the lamp base assembly 20 in a conventional manner. The base 22 and cup-shaped element 44 may be coupled together by ultrasonic welding or by screws and the like. The configuration of the groove 70 is essentially flash-free.

In the embodiment illustrated in FIG. 1, the mounting element 46 of the attachment member 40 comprises a cylindrical segment 72. The mounting element 46 also comprises at least one surface extending in a radial direction relative to the axis of the cylindrical segment 72. For example, in the embodiment illustrated in FIG. 1, the mounting element 46 includes a plurality of surfaces in the form of legs 74 which extend radially relative to the axis of the cylindrical segment 72. The diameter of the cylindrical segment 72 is equal to or slightly less than the diameter of a recess 76 of the cup-shaped element 44. The cylindrical segment 72 is force fit into the recess 76 and the legs 74 engage an upper surface 78 of element 44.

Figure 3:
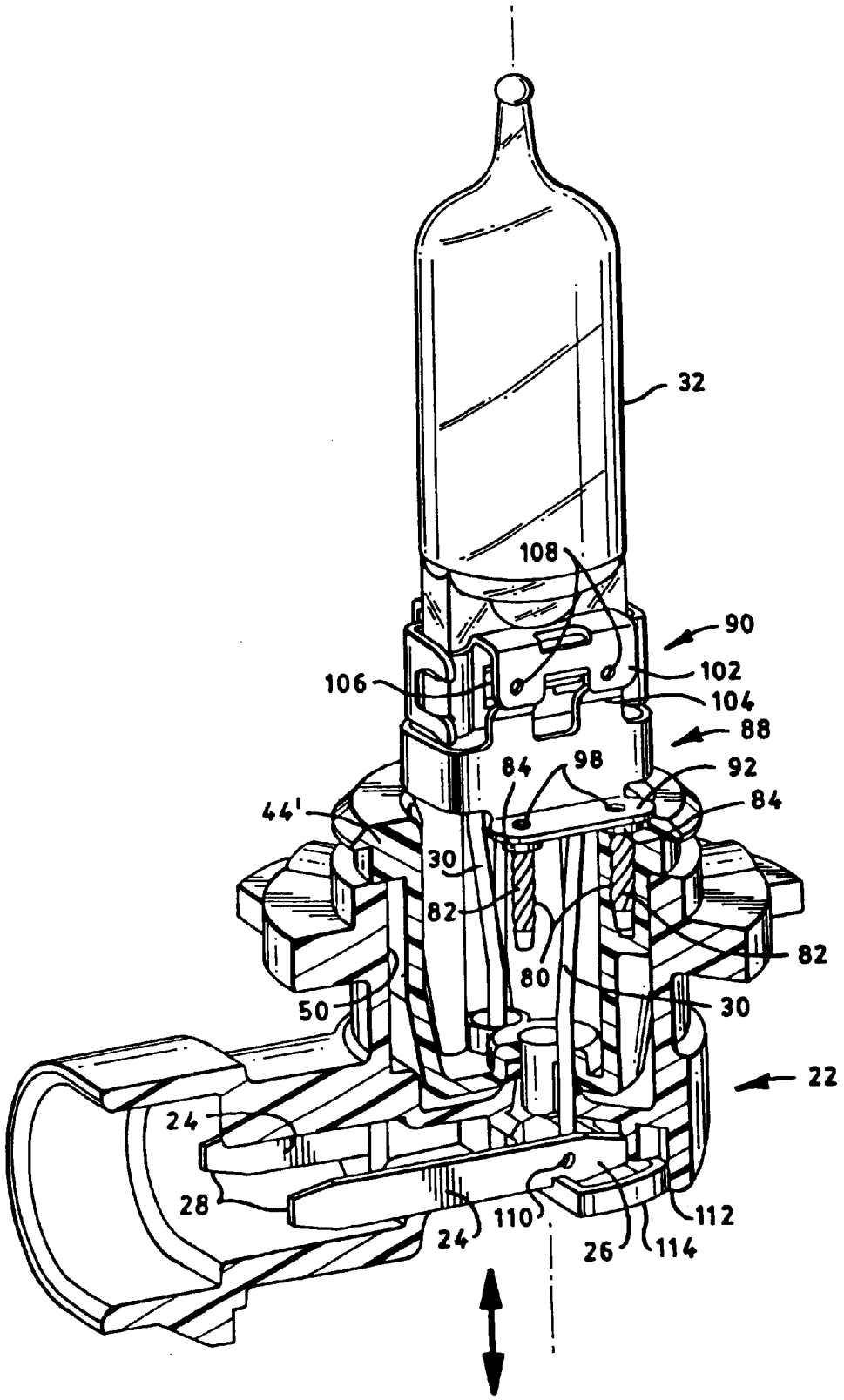
FIG. 3 is a perspective view partially in section of another lamp base assembly of FIG. 1.

In the embodiment illustrated in FIGS. 1 and 3, the cup-shaped element 44' is similar to the cup-shaped element 44. In particular, element 44' comprises an outer peripheral partially cylindrical surface 58' which is inserted into the recess 50 in the same manner in which the element 44 is inserted into recess 50. Element 44' differs from element 44 to the extent that element 44' is structured and arranged for attachment thereto of a mounting element which differs from mounting element 46. In particular, the element 44' includes a plurality of recesses 80 into which respective pins 82 are inserted. The heads 84 of pins 82 collectively form mounting element 46'. Pins 82 may be stainless steel spiral drive pins, and may be in the form of Type U metallic drive screws manufactured by Parker-Kalon. Use of such screws eliminates the need for the element 44' to have a metal piece to receive the pins. In particular, such screws may be pressed into recesses 80.

In the embodiment illustrated in FIG. 1, lamp retainer 48 includes a stainless steel first segment 88 attachable to the mounting elements 46 or 46' and a second segment 90 attachable to the first segment 88 and to lamp 32.

With reference to FIGS. 1 to 3, the segment 88 includes identical wings 92 which extend from opposing walls 94, in a radial direction relative to an axis of the segment 88. During assembly of the lamp base assembly illustrated in FIG. 2, the bottom surface of each wing 92 engages the upper surface of respective legs 74. During the assembly of the lamp base assembly of FIG. 3, the bottom surface of the wings 92 engages the upper surface of a respective head 84. In order to provide proper focusing to enhance the beam pattern of the lamp 32 being attached to the lamp base assembly 20, the segment 88 may be adjusted in a focusing mode relative to the attachment member 40, 42 by sliding the wings 92 in an X-Y plane upon the legs 74, or heads 84, as the case may be, in any direction transverse to axis 56. When focusing in such X-Y plane is achieved, the wings 92 may be welded to the legs 74, or heads 84, at welds 98. In the embodiment illustrated in FIG. 3, such welding also serves to prevent rotation of the pins 82.

With reference to FIGS. 1 to 3, the segment 88 includes legs 100 which extend away from the wings 92. Segment 90 includes legs 102. Legs 100 and 102 may be structured and arranged such that respective outer surfaces 104 of legs 100 are spring biased against respective inner surfaces 106 of legs 102 to hold the segment 90 in place relative to the segment 88. In order to further provide proper focusing of the lamp 32 to be attached to the lamp base assembly 20, the segments 88 and 90 may be adjusted relative to each other in a focusing mode by sliding the inner surfaces 106 of legs 102 upon the outer surfaces 104 of legs 100 in a direction of a retainer axis (Z plane), such retainer axis extending in direction 54 when the segment 88 has been attached to the mounting element 46, 46'. When the focusing in such Z-plane is achieved, the legs 100 may be welded to respective legs 102 at 108. It will be noted that the segment 88 is substantially rectangular. Such a configuration allows for positioning the welds 108 relatively close to the axis 56 which allows for optimum translational movement of segment 88 during focusing. The two segment lamp retainer 48 allows for 5-axis laser welding of the retainer thereby providing substantially improved focussing tolerances. By providing a lamp such as, for example, lamp 32 with molybdenum lead wires 30, flexing of the lead wires and movement of the capsule during the 5-axis focusing process is facilitated. This feature is important since such flexing will eliminate any undesirable internal forces remaining caused by the lead wires acting on the lamp 30/segment 90 interface. Such forces are undesirable since they tend to impart excess stress in the glass lamp press and cause lamp explosions.

Figure 4:
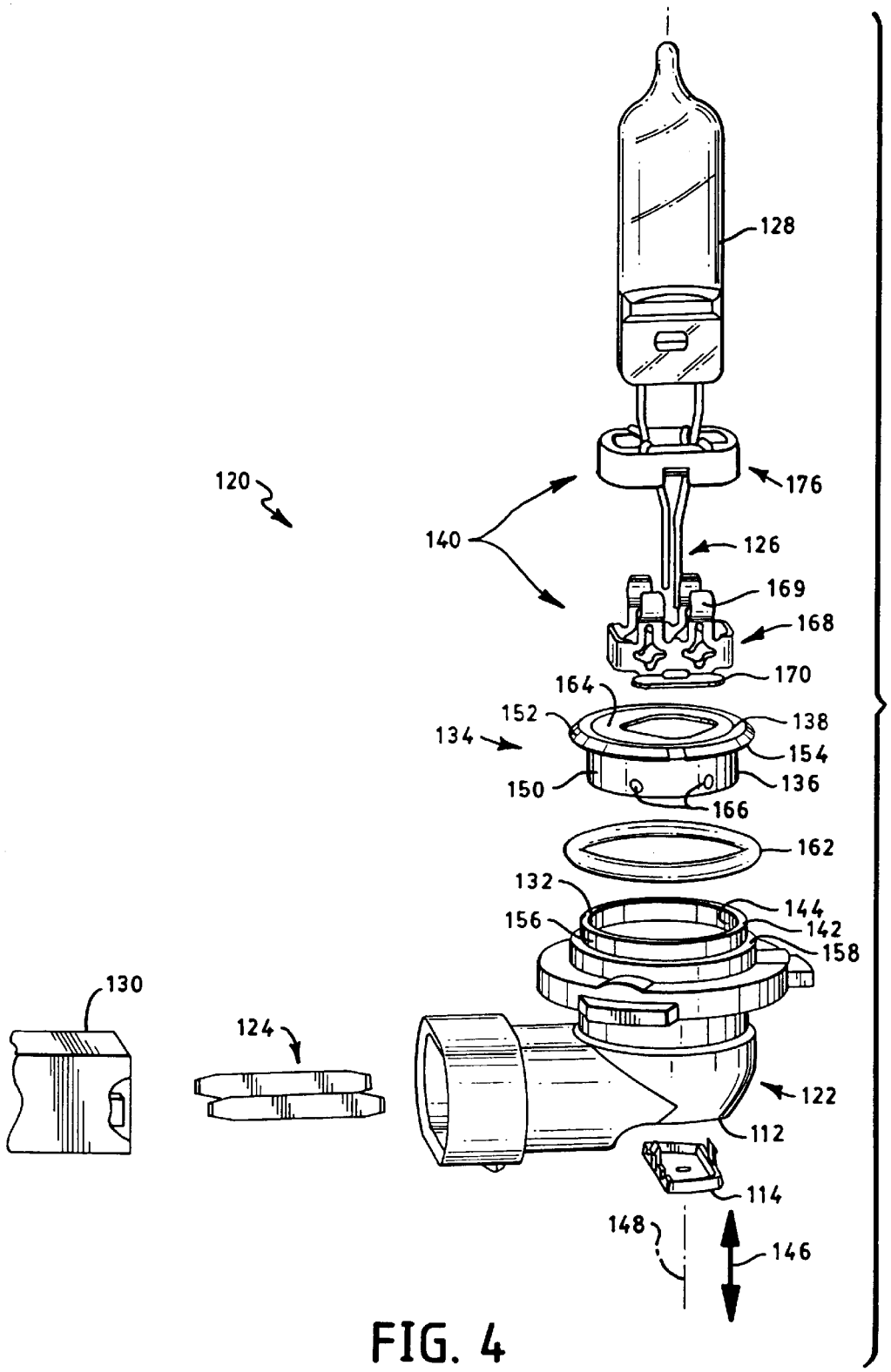
FIG. 4 is an exploded perspective view of another embodiment of the present invention.
Figure 5:
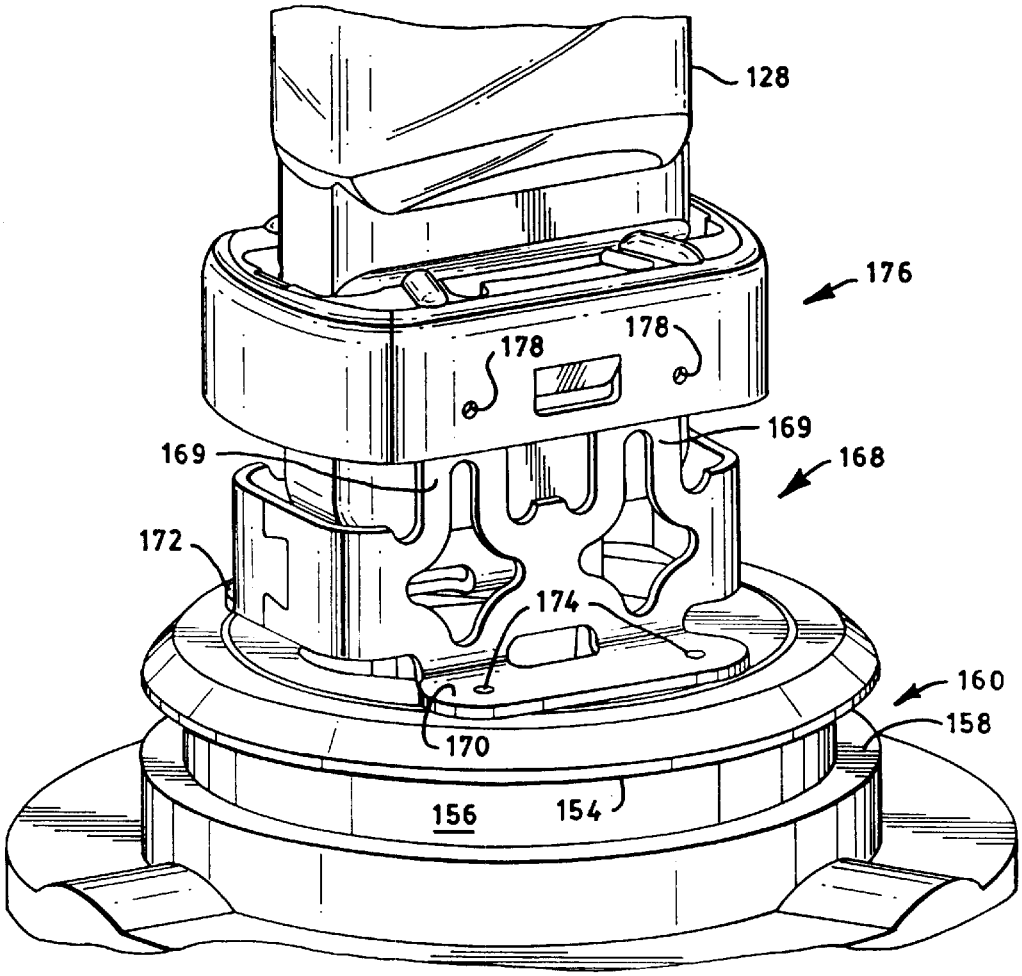
FIG. 5 is an enlarged perspective view of a portion of the embodiment of FIG. 4.

The manner in which the base contacts are connected to the lamp lead wires is illustrated with respect to the embodiment depicted in FIG. 3 and is equally applicable to the embodiments illustrated in FIGS. 2, 4 and 5. With reference to FIG. 3, contacts 24 are brass, and lead wires 30 are nickel plated. Contacts 24 are electrically and mechanically connected to respective lead wires 30 of lamp 32 by resistance welding at 110. Such welding may be effected through an opening 112 which may be subsequently closed with a cover 114. Cover 114 may be press fit into opening 112 and may include barbs (not shown) to assure the attachment thereto. A sealant may be provided at the opening 112/cover 114 interface to prevent leakage. Such sealant may be, for example, silicone. In this embodiment, contacts 24 are exactly symmetrical from top to bottom and end to end. This simplifies feeding of the material during processing and thereby lowers the cost of stamping the contacts.

In an alternative embodiment illustrated in FIGS. 4 and 5, a lamp base assembly 120 is illustrated. Lamp base assembly 120 comprises a base 122 having contacts 124 therein which are structured and arranged for mechanical and electrical connection to (a) lamp lead wires 126 of lamp 128 and (b) a connector 130, in a manner similar to the embodiment of FIGS. 1 to 3. Like contacts 24, contacts 124 are symmetrical top to bottom and end to end, and are brass.

The lamp base 122 comprises a base mounting portion 132 which is structured and arranged for attachment to an attachment member or nose in the form of a mounting element 134. Mounting element 134 comprises a cylindrical segment 136 attachable to the base mounting portion 132, and a radial surface 138 attachable to a lamp retainer 140. The base mounting portion 132 includes a recess 142 which comprises a cylindrical inner wall 144 which extends in direction 146 of base axis 148. It will be noted that the lamp retainer 140 is different from the lamp retainer 48 of FIGS. 1 to 3. Lamp retainers 48 and 140 are designed to accommodate a different type of lamp 32 and 128, respectively.

In the embodiment of FIGS. 4 and 5, the cylindrical segment 136 comprises an outer peripheral cylindrical surface 150. The radial surface 138 includes a flange 152 having a diameter greater than the diameter of the recess 142. In assembling the lamp base assembly 120, the cylindrical segment 136 is force fit into the recess 142 until the flange 152 engages the base mounting portion 132 as illustrated in FIG. 5. Essentially, the surface 150 will mate with the surface 144. With reference to FIGS. 4 and 5, the surface 154 of flange 152, the outer peripheral surface 156 of the base mounting portion 132 and a flanged surface 158 of the base will form a groove 160 into which a gasket or O-ring 162 may be inserted to provide a seal for use with the lamp base assembly 120 in a conventional manner.

In the embodiment of FIGS. 4 and 5, the mounting element 134 is a single piece which is designed for attachment to the base 122 and the lamp retainer 140. In contrast, in the embodiment of FIGS. 1 to 3, each attachment member 40, 42 comprises two pieces including the cup-shaped element 44, 44' and the mounting element 46, 46', respectively. In a preferred embodiment, the mounting element 134 is a deep drawn metal can having a ring of plastic, such as Amoco Amodel 1145, partially molded onto it such that the top 164 of the can provides an exposed metal platform and the remainder of the flange provides a plastic ring. During manufacture of the mounting element 134, the plastic flows through holes 166 from the outside of the metal can to the inside. This facilitates affixation of the plastic to the metal. The surface 154 of the plastic ring portion of the flange 152 forms the top of the groove 160 in the embodiment as illustrated in FIGS. 4 and 5.

In the embodiment of FIGS. 4 and 5, the base 122 is fabricated from low temperature plastic. The metal mounting element 134 shields the plastic base from sufficient heat to prevent outgassing or melting. Like groove 70 of the embodiment of FIGS. 1 to 3, the groove 160 is flash-free; the bottom and inside of the groove 160 are formed with a die draw thereby eliminating any parting lines in the O-ring groove.

In the embodiment illustrated in FIGS. 4 and 5, the lamp retainer 140 includes a first segment 168 attachable to the mounting element 134 in a manner similar to that described herein regarding segment 88 of the embodiment illustrated in FIGS. 1 to 3. To this end, after focusing lamp 128 in an X-Y plane which is perpendicular to axis 148, wings 170 and 172 are welded to the metal platform 164 of the radial surface 138 at welds 174. Similarly, a second segment 176 is provided which is attachable to the first segment 168 after the lamp 128 has been focussed in the Z axis in a manner similar to that provided with respect to the embodiments of FIGS. 1 to 3. The Z axis extends in direction 146. Attachment of the segment 176 to the segment 168 may be effected by welding the two together at the spring arms 169 at weld points.

In the embodiment illustrated in FIGS. 1 to 5, the bases 22 and 122 are extruded, molded or otherwise fabricated as a one piece unit. In an alternative embodiment, the bases 22 and 122 may be modified to provide a first component and a separate second component attachable to the first component so that the base 22 or base 122 may be provided in the form of a straight base configuration or an angled configuration such as a 90 degree base configuration. Such structure also allows for providing a more expensive high temperature plastic base component nearest the lamp and a less expensive low temperature base component furthest from the lamp. For example, FIGS. 6 to 12 illustrate another embodiment of the present invention wherein the lamp base may be altered to provide a straight base configuration or an angled configuration such as a 90 degree base configuration.

Figure 6:
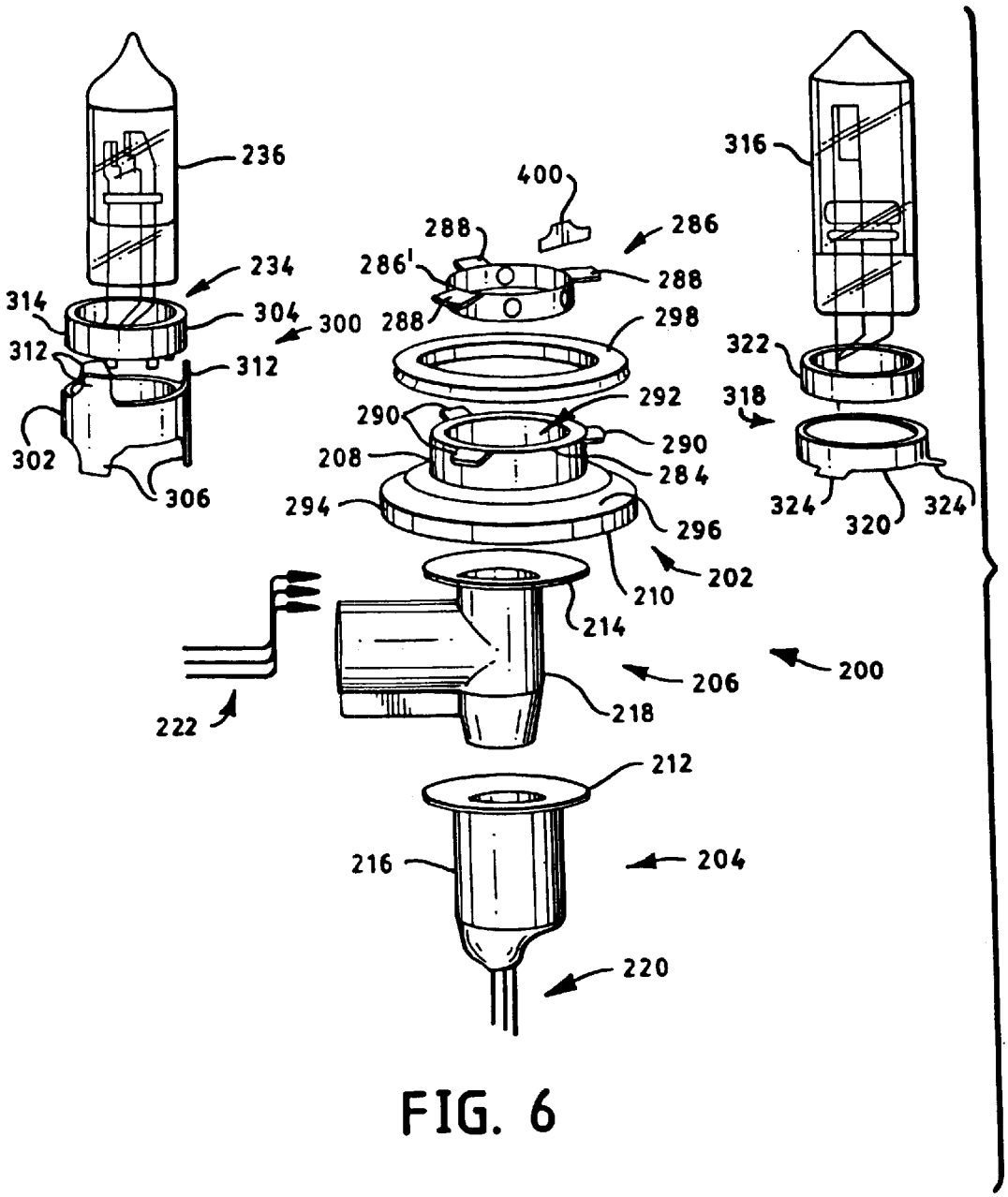
FIG. 6 is an exploded perspective view of a further embodiment of the present invention illustrating two other alternative lamp base assemblies.

With reference to FIG. 6, a lamp base assembly 200 is provided which includes a base comprising a high temperature plastic first base component 202 and a low temperature plastic second base component in the form of a straight base component 204, or a 90 degree base component 206, either of which is attachable to the first base component 202.

The first base component 202 comprises a first portion 208 structured and arranged for attachment to a lamp and a second portion 210 structured and arranged for attachment to the second base component 204 or 206, as desired. Each second base component 204 and 206 comprises a respective third portion 212 and 214 structured and arranged for attachment to the second portion 210. Each second base component 204 and 206 also comprises a respective fourth portion 216 and 218 comprising respective stainless steel contacts 220 and 222 structured and arranged for electrical and mechanical connection with (a) lead wires of a lamp and (b) a connector.

Figure 8:
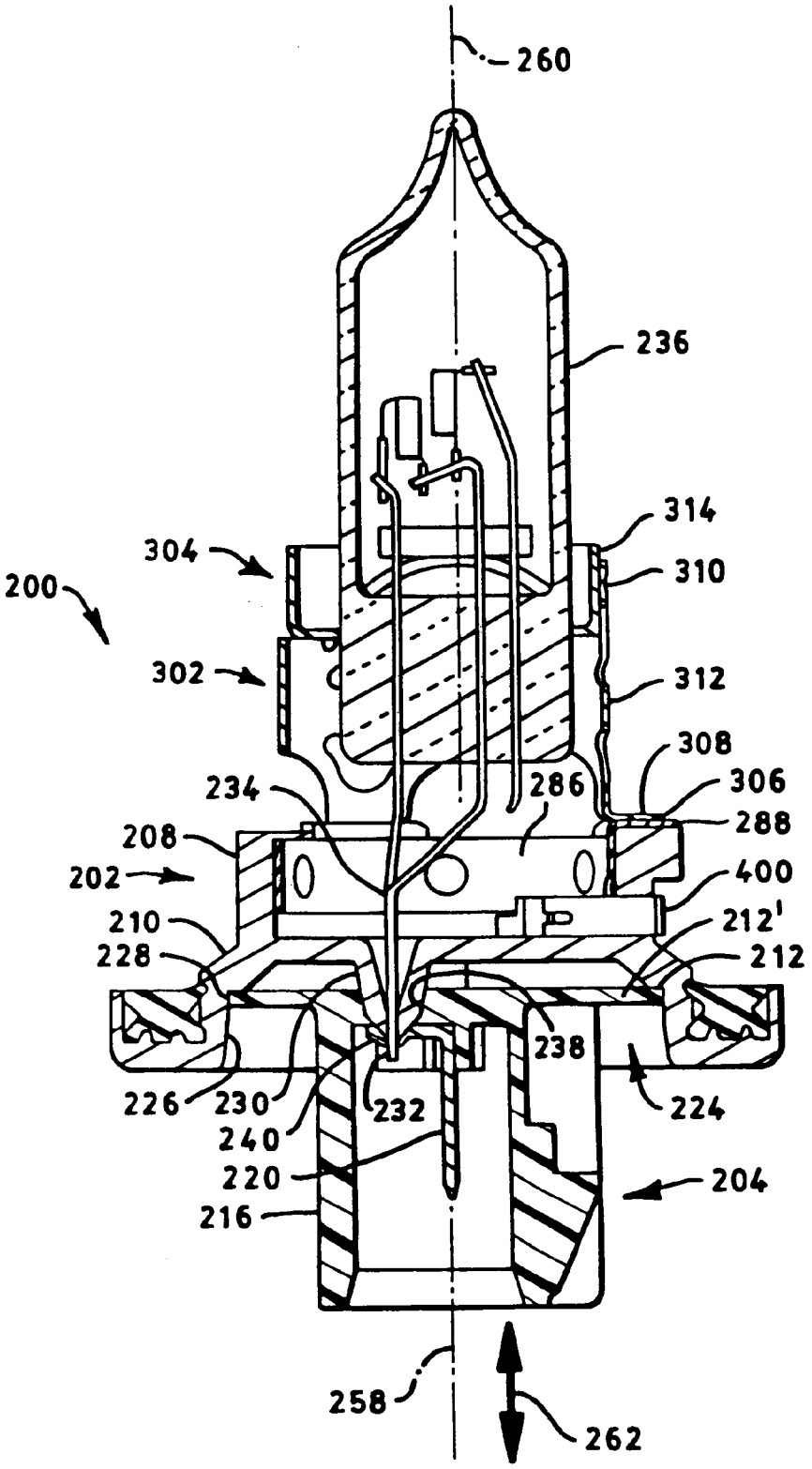
FIG. 8 is a cross-section of FIG. 7 taken along lines 8—8.
Figure 7:
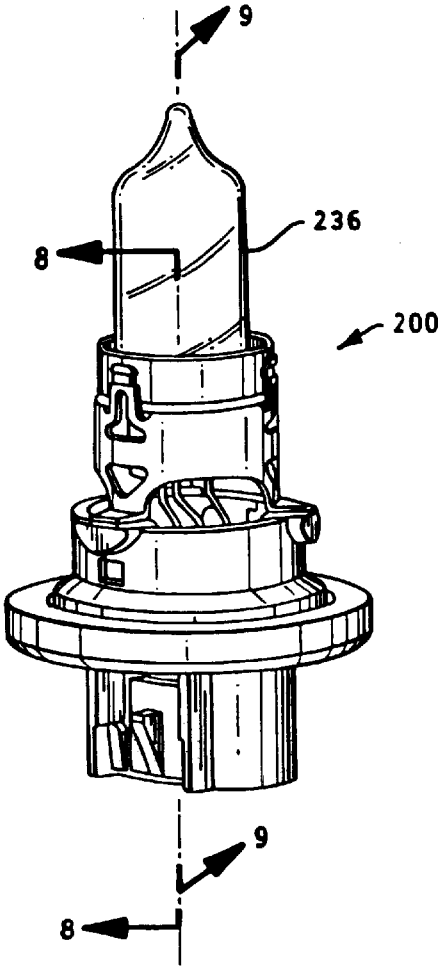
FIG. 7 is a perspective view of one lamp base assembly of FIG. 6.
Figure 9:
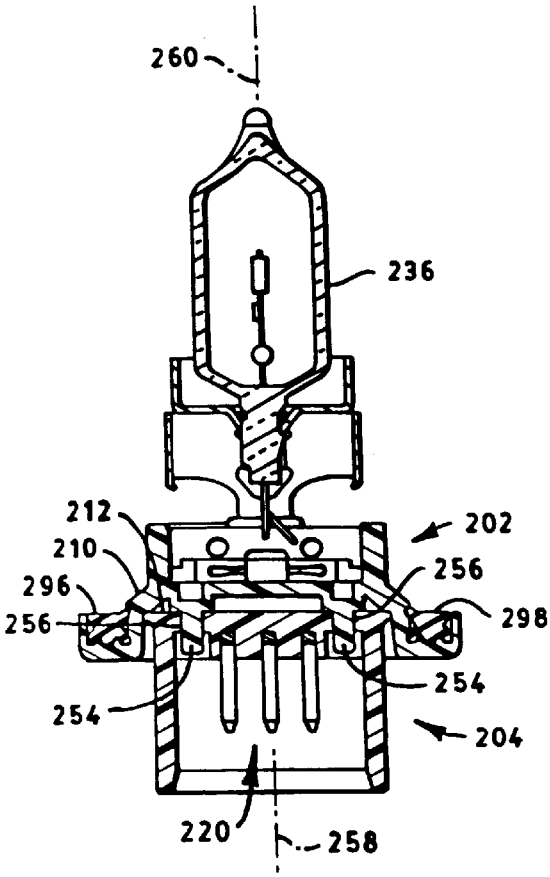
FIG. 9 is a cross-section of FIG. 7 taken along lines 9—9.

FIGS. 7 to 11 illustrate the lamp base assembly 200 in an embodiment where the base component 202 is attached to a straight base component 204. With reference to FIG. 8, the portion 210 of the base component 202 comprises a receptacle 224, and the portion 212 of the base component 204 provides an insert 212' which is configured to mate with such receptacle. The inner wall 226 of the receptacle 224 and the outer peripheral wall 228 of the insert 212' are substantially cylindrical and of equal diameter.

Figure 10:
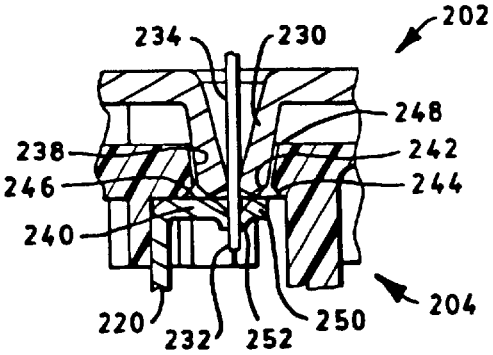
FIG. 10 is an enlargement of a portion of FIG. 8 rotated 180°.
Figure 11:
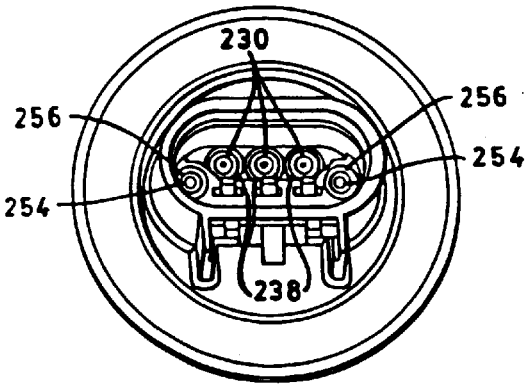
FIG. 11 is a bottom view of FIG. 7.

In the embodiment of the present invention illustrated in FIGS. 7 to 11, the portion 210 of the base component 202 may comprise at least one apertured protrusion through which the distal ends of lead wires of a lamp will protrude when the lamp is coupled to the lamp base. In such embodiment, the portion 212 of the base component 204 will comprise at least one corresponding aperture which is structured and arranged to mate with at least one apertured protrusion so that such apertured protrusion will extend into such corresponding aperture when the lamp base is assembled. For example, with reference to FIGS. 8, 10 and 11, there are three apertured protrusions 230 each of which is structured and arranged so that a respective lead wire end 232 of a lead wire 234 of the plurality of lead wires will extend therethrough when the lamp 236 is coupled to the lamp base assembly 200. Each apertured protrusion 230 mates with and extends into a respective aperture 238 of the portion 212 of the component 204. In the embodiment illustrated in FIGS. 8, 10 and 11, a contact end of at least one contact 220 is structured and arranged so as to be adjacent a respective lead wire end when the lamp has been coupled to the lamp base. For example, contact end 240 illustrated in FIGS. 8 and 10 is adjacent lead wire end 232.

In the embodiment illustrated in FIGS. 8 and 10, each apertured protrusion 230 is in the form of a truncated cone and comprises a bevelled distal end 242, and each aperture 238 comprises a bevelled peripheral edge 244. The bevelled distal end 242 is adjacent the bevelled peripheral edge 244 to form a V-shaped circular groove 246 adjacent the interface 248 of the apertured protrusion 230 and aperture 238. To perfect a seal at the interface of the base components 202 and 204 a UV sealant may be provided which runs around the groove 246 forming a complete sealing ring.

In the embodiment illustrated in FIGS. 8 and 10, the contact end 240 of the contact 220 comprises a funnel-shaped segment 250 having an apex 252 extending away from the aperture 238 when the base components 202 and 204 are attached to each other. In such embodiment, the lamp wire end 232 extends into and through the funnel-shaped segment 250. It will be noted that in the configuration illustrated in FIGS. 8 and 10, the lead wire end 232 extends beyond the apex 252 of the contact 220. One processing advantage of this design is that the length of such extended portion of the contact will not be critical since the lead wire 234 is laser welded to the contact 220 on the outer side of the funnel shaped segment 250 and is melted into the lead wire.

The portion 210 of base component 202 may comprise at least one heat stake pin, and the portion 212 of base component 204 may comprise at least one hole structured and arranged to mate with a respective heat stake pin. For example, with reference to FIGS. 9 and 11, the portion 210 includes two heat stake pins 254 and the portion 212 includes two holes 256 which mate with a respective heat stake pin. The pins 254 and the holes 256 are off center relative to a longitudinal axis 258 of the base components 202 and 204, such axis being coincident with the axis 260 of the lamp. In this manner, the pins act as rotational keys during assembly. Pins 254 serve to facilitate coupling the base component 202 to the base component 204 by ultrasonically welding the components together where the pins 254 and holes 256 engage one another. Pins 254 are designed to mate with (a) holes 256 in the straight base component 204 and (b) similar holes (not shown) in the right angle base component 206.

Figure 12:
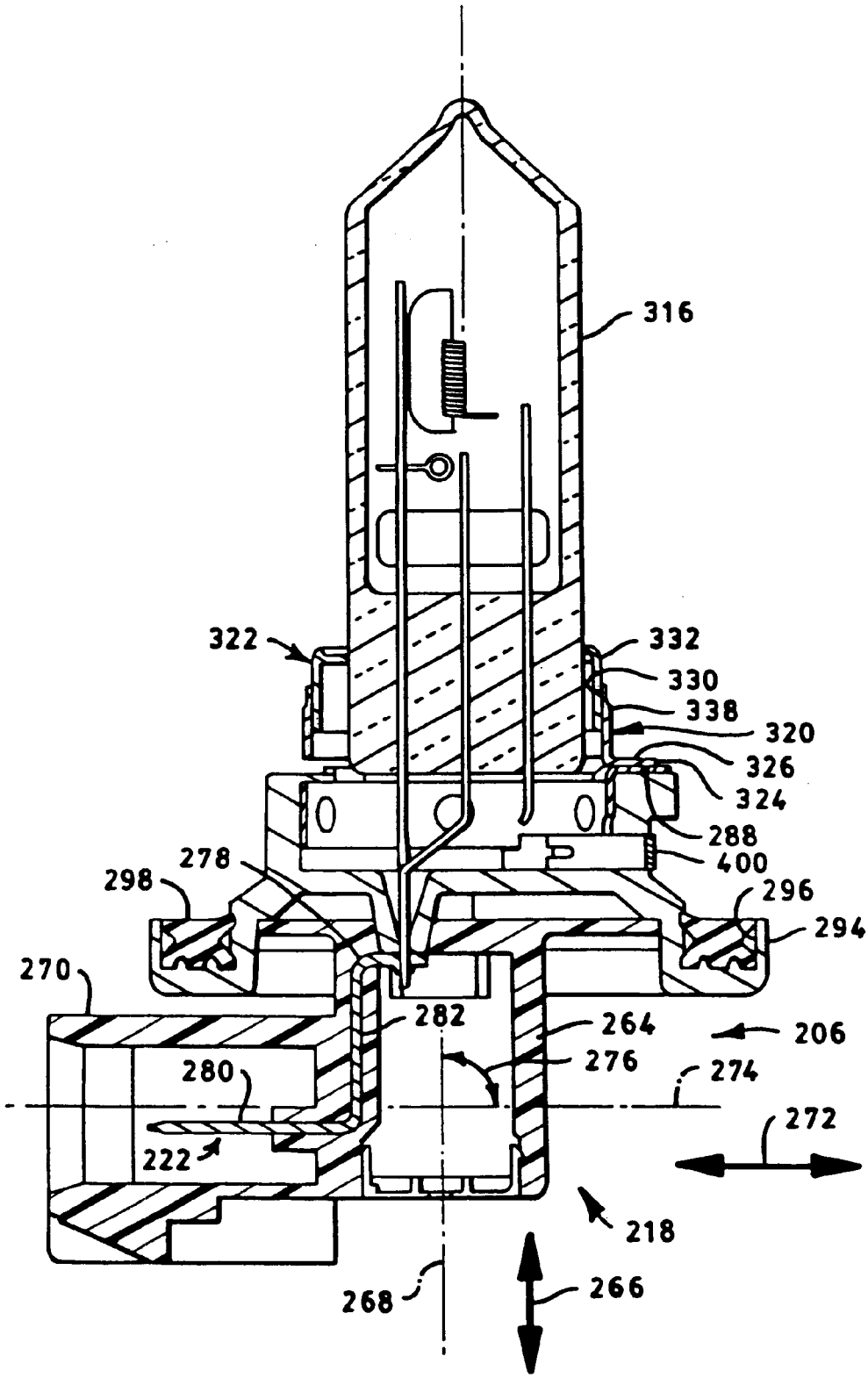
FIG. 12 is a cross section similar to FIG. 8 of another lamp base assembly of FIG. 6.

The lamp base illustrated in FIG. 12 is identical to the lamp base illustrated in FIGS. 7 to 11 with the exception that the second lamp component 206 and the contacts 222 are structured and arranged to provide a 90 degree base configuration. Therefore, the lamp base assembly and the lamp in each embodiment may be assembled using the same process and apparatus. In the embodiment of FIGS. 7 to 11, and with particular reference to FIG. 8, the portion 216 of base segment 204 extends in the direction 262 of a axis 258. The contacts 220 are L-shaped in this embodiment. With reference to FIG. 12, the portion 218 includes one segment 264 which extends in the direction 266 of a base axis 268 and a second segment 270 which extends in the direction 272 of an axis 274 which is at an angle 276 relative to axis 268. In the embodiment of FIG. 12, angle 276 is 90°. In the embodiment illustrated in FIG. 12, the contacts 222 are S-shaped, each having legs 278 and 280 extending in direction 272 and joined by a leg 282 extending in direction 266 to provide a 90° degree connector. Contacts 222 are molded into the base component 206.

Like the embodiments illustrated in FIGS. 1 to 5, the embodiments illustrated in FIGS. 6 to 12 provide a lamp base assembly comprising a base having a base mounting portion structured and arranged for attachment to any one of a plurality of differently configured lamp attachment members or noses. For example, FIG. 6 illustrates a base mounting portion 284 to which an attachment member in the form of a mounting element 286 may be attached. The mounting element 286 comprises a cylindrical segment 286' and radially projecting legs 288 which are structured and arranged to engage radially projecting legs 290 of the base mounting portion 284 of base component 202. The mounting element 286 is attached to the base component 202 by inserting the cylindrical insert 286' into a recess 292 of the portion 208 until the legs 288 engage legs 290. The cylindrical insert 286' may be press fit into the recess 292.

The base component 202 includes a flange 294 having a recess 296 therein into which a gasket or O-ring 298 may be inserted.

In the embodiment illustrated in FIG. 6, two different two piece lamp retainers for use with two different lamps are illustrated, each being attachable to the radial surfaces 288 of the mounting element 286. For example, lamp 236 may be coupled to the lamp base assembly using the lamp retainer 300. In particular, lamp retainer 300 comprises cylindrical segments 302 and 304. Segment 302 may be adjusted relative to the mounting element 286 for focusing lamp 236 in an X-Y plane which is perpendicular to axis 258, as described herein regarding the embodiment of FIGS. 1 to 5, by sliding the radially extending legs 306 of segment 302 upon legs 288 and then welding the pairs of legs together at 308 as illustrated in FIG. 8. The segments 302 and 304 may also be adjusted relative to each other for focusing lamp 236 in a Z plane which, extends in the direction 262, as described herein regarding the embodiments of FIGS. 1 to 5, by axially sliding the segments relative to each other and then welding the segments together to provide welds 310 where the axially extending legs 312 of segment 302 engage an outer surface 314 of the segment 304 as illustrated in FIG. 8.

Lamp 316 may be coupled to the lamp base assembly 200 by the lamp retainer 318. In particular, lamp retainer 318 comprises cylindrical segments 320 and 322 which may be adjusted relative to each other for focusing purposes, as described herein regarding the embodiments of FIGS. 1 to 5. In particular, segment 320 may be adjusted relative to the mounting element 286 for focusing the lamp 316 in the X-Y plane as described herein regarding the embodiment of FIGS. 1 to 5, by sliding the radially extending legs 324 of segment 320 upon legs 288 and then welding the pairs of legs together at 326 as illustrated in FIG. 12. The segments 320 and 322 may also be adjusted in the Z plane by axially sliding the segments relative to each other and then welding the segments together to provide welds 328 where an inner surface 330 of segment 320 engages an outer surface 332 of the segment 322 as illustrated in FIG. 12.

The lamp base assembly of the present invention is typically combined with a reflector (not shown) to form a vehicle headlamp system. To this end, each of the lamp base assemblies of the present invention may include a spring which is useful in facilitating the accurate positioning of the lamp base assembly, and lamp attached thereto, relative to the reflector. Such a spring 400 is illustrated in FIGS. 6, 8 and 12. The use of such a spring 400 is described in U.S. Pat. No. 5,855,430 to Coushaine et al. This patent is commonly owned with the instant application, and is incorporated herein by reference.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A lamp base assembly, comprising:

a first base component comprising a first portion structured and arranged for attachment to a lamp, and an opposite second portion structured and arranged for attachment to a separate second base component; and a separate second base component comprising a third portion structured and arranged for attachment to said second portion, and a fourth portion comprising contacts structured and arranged for mechanical and electrical connection with (a) lead wires of said lamp and (b) a connector, said second base component being one of a straight second base component and an angled second base component.

2. The lamp base assembly of claim 1 wherein said second portion comprises a receptacle and said third portion comprises an insert, said insert being configured to mate with said receptacle.

3. The lamp base assembly of claim 1 wherein said second base component is a straight second base component.

4. A lamp base assembly, comprising:

a first base component comprising a first portion structured and arranged for attachment to a lamp, and an opposite second portion structured and arranged for attachment to a separate second base component; and a separate second base component comprising a third portion structured and arranged for attachment to said second portion, and a fourth portion comprising contacts structured and arranged for mechanical and electrical connection with (a) lead wires of said lamp and (b) a connector, said second base component being one of a straight second base component and an angled second base component; wherein said second portion comprises a receptacle and said third portion comprises an insert, said insert being configured to mate with said receptacle wherein said second portion comprises at least one heat stake pin and said third portion includes at least one hole structured and arranged to mate with said at least one heat stake pin.

5. The lamp base assembly of claim 4 wherein said at least one heat stake pin and hole includes two heat stake pins and two holes, said two heat stake pins being off center, and said two holes being off center, relative to a longitudinal axis of said first base component and said second base component, respectively.

6. A lamp base assembly comprising:

a first base component comprising a first portion structured and arranged for attachment to a lamp, and an opposite second portion structured and arranged for attachment to a separate second base component; and a separate second base component comprising a third portion structured and arranged for attachment to said second portion, and a fourth portion comprising contacts structured and arranged for mechanical and electrical connection with (a) lead wires of said lamp and (b) a connector, said second base component being one of a straight second base component and an angled second base component wherein said first component is a high temperature plastic and said second component is a lower temperature plastic.

7. A lamp base assembly, comprising:

a first base component comprising a first portion structured and arranged for attachment to a lamp, and an opposite second portion structured and arranged for attachment to a separate second base component; and a separate second base component comprising a third portion structured and arranged for attachment to said second portion, and a fourth portion comprising contacts structured and arranged for mechanical and electrical connection with (a) lead wires of said lamp and (b) a connector, said second base component being one of a straight second base component and an angled second base component, wherein said second portion comprises a receptacle and said third portion comprises an insert, said insert being configured to mate with said receptacle wherein said third portion includes at least one aperture, and said second portion includes at least one apertured protrusion structured and arranged to extend into said at least one aperture, a contact end of at least one contact of said contacts being disposed adjacent said aperture, and said apertured protrusion being further structured and arranged for receiving at least one lead wire of said lead wires.

8. The lamp base assembly of claim 3 wherein said contact end comprises a funnel-shaped segment having an apex extending away from said aperture, said lead wire end extending into said funnel-shaped segment.

9. The lamp base assembly of claim 7 wherein each apertured protrusion includes a beveled distal end, and each aperture includes a beveled peripheral edge, said beveled distal end being adjacent said beveled peripheral edge and forming a V-shaped groove adjacent an interface of said apertured protrusion and said aperture.

10. A lamp base assembly, comprising:

a first base component comprising a first portion structured and arranged for attachment to a lamp, and an opposite second portion structured and arranged for attachment to a separate second base component; and a separate second base component comprising a third portion structured and arranged for attachment to said second portion, and a fourth portion comprising contacts structured and arranged for mechanical and electrical connection with (a) lead wires of said lamp and (b) a connector, said second base component being one of a straight second base component and an angled second base component wherein said second base component is a 90° angled second base component.

11. A lamp base assembly, comprising:

a first base component comprising a first portion structured and arranged for attachment to a lamp, and an opposite second portion structured and arranged for attachment to a separate second base component; and a separate second base component comprising a third portion structured and arranged for attachment to said second portion, and a fourth portion comprising contacts structured and arranged for mechanical and electrical connection with (a) lead wires of said lamp and (b) a connector, said second base component being one of a straight second base component and an angled second base component wherein said second portion includes a peripherally extending channel adapted to receive a gasket.

12. A lamp base assembly, comprising a base; contacts within said base structured and arranged for mechanical and electrical connection with lead wires of a lamp and a connector; said base having a base mounting portion structured and arranged for attachment to any one of a plurality of differently configured lamp attachment members; and a lamp attachment member of said plurality of differently configured lamp attachment members having one portion attachable to said base mounting portion and another portion attachable to a lamp retainer.

13. The lamp base assembly of claim 12 wherein said base mounting portion includes a first recess, and said one portion of said lamp attachment member includes an outer peripheral surface which extends into and mates with said first recess.

14. The lamp base assembly of claim 12 wherein said base comprises a first base component and a separate second base component, said first base component comprising a first portion comprising said base mounting portion and an opposite second portion structured and arranged for attachment to said second base component, said second base component comprising a third portion structured and arranged for attachment to said second portion, and a fourth portion structured and arranged for attachment to said connector, said second base component being one of a straight second base component and an angled second base component.

15. A lamp base assembly, comprising a base; contacts within said base structured and arranged for mechanical and electrical connection with lead wires of a lamp and a connector; said base having a base mounting portion structured and arranged for attachment to any one of a plurality of differently configured lamp attachment members; and a lamp attachment member of said plurality of differently configured lamp attachment members having one portion attachable to said base mounting portion and another portion attachable to a lamp retainer; wherein said base mounting portion includes a first recess, and said one portion of said lamp attachment member includes an outer peripheral surface which extends into and mates with said first recess wherein said one portion is a cup-shaped element, having a second recess therein, structured and arranged for insertion into said first recess, and further wherein said another portion is a cylindrical segment structured and arranged for insertion into said second recess.

16. The lamp base assembly of claim 15 wherein said mounting portion comprises a first flange adjacent said first recess, and said cup-shaped element comprises a second flange adjacent said second recess and a third flange adjacent said second flange, said first, second and third flanges being structured and arranged to form a channel adapted to receive a gasket, opposing sides of said channel being formed by said first flange and said second flange, and a base of said channel being formed by said third flange.

17. The lamp base assembly of claim 16 wherein said cylindrical segment includes at least one radially extending surface structured and arranged for attachment to said lamp retainer.

18. A lamp base assembly, comprising a base; contacts within said base structured and arranged for mechanical and electrical connection with lead wires of a lamp and a connector; said base having a base mounting portion structured and arranged for attachment to any one of a plurality of differently configured lamp attachment members; and a lamp attachment member of said plurality of differently configured lamp attachment members having one portion attachable to said base mounting portion and another portion attachable to a lamp retainer; wherein said base mounting portion includes a first recess, and said one portion of said lamp attachment member includes an outer peripheral surface which extends into and mates with said first recess wherein said one portion is a cup-shaped element, having a second recess therein, structured and arranged for insertion into said first recess, and further wherein said another portion comprises a plurality of pins extending into said cup-shaped element and structured and arranged for attachment to said lamp retainer.

19. The lamp base assembly of claim 18 wherein said mounting portion comprises a first flange adjacent said first recess, and said cup-shaped element comprises a second flange adjacent said second recess and a third flange adjacent said second flange, said first, second and third flanges being structured and arranged to form a channel adapted to receive a gasket, opposing sides of said channel being formed by said first flange and said second flange, and a base of said channel being formed by said third flange.

20. A lamp base assembly, comprising a base; contacts within said base structured and arranged for mechanical and electrical connection with lead wires of a lamp and a connector; said base having a base mounting portion structured and arranged for attachment to any one of a plurality of differently configured lamp attachment members; and a lamp attachment member of said plurality of differently configured lamp attachment members having one portion attachable to said base mounting portion and another portion attachable to a lamp retainer; wherein said base mounting portion includes a first recess, and said one portion of said lamp attachment member includes an outer peripheral surface which extends into and mates with said first recess; wherein said one portion comprises a cylindrical segment which includes said outer peripheral surface, and said another portion includes at least one radially extending surface extending from said cylindrical segment and structured and arranged for attachment to said lamp retainer.

21. The lamp base assembly of claim 20 wherein said base mounting portion comprises an outer peripheral surface adjacent said recess and a flange adjacent said outer peripheral surface, said radially extending surface, said outer peripheral surface and said flange being structured and arranged to form a channel adapted to receive a gasket, opposing sides of said channel being formed by said flange and said radially extending surface, and a base of said channel being formed by said outer peripheral surface.

22. A lamp, comprising a first base component and a separate second base component, said first base component comprising a first portion attached to a lamp retainer and an opposite second portion, said separate second base component comprising a third portion attached to said second portion and a fourth portion comprising contacts structured and arranged for connection with a connector, and a lamp, said lamp being connected to said lamp retainer and comprising lead wires electrically and mechanically connected to said contacts, said second base component being one of a straight second base component and an angled second base component.

23. A lamp, comprising a base, contacts within said base structured and arranged for mechanical and electrical connection with a connector, said base comprising a base mounting portion structured and arranged for attachment to any of a plurality of differently configured lamp attachment members, a lamp attachment member of said plurality of differently configured lamp attachment members comprising one portion attached to said base mounting portion and another portion attached to a lamp retainer, and a lamp, said lamp being connected to said lamp retainer and comprising lead wires electrically and mechanically connected to said contacts.

24. The lamp of claim 23 wherein said base comprises a first base component and a separate second base component, said first base component comprising a first portion comprising said base mounting portion and an opposite second portion, said separate second base component comprising a third portion attached to said second portion, and a fourth portion structured and arranged for attachment to said connector, said second base component being one of a straight second base component and an angled second base component.

25. A vehicle lamp base assembly comprising:

a vehicle lamp (32) with electrical lead wires (30) extending therefrom;

a lamp holder including a first portion (90) mechanically attached to the lamp, and a second portion (92) providing an adjustment surface for adjustable attachment along said surface;

an adapter (46, 58; 84, 58') including an adjustment surface structured and adapted for adjustable surface to surface attachment with said lamp holder adjustment surface, the lamp holder and the adapter being positional adjusted one with respect to the other and coupled one to the other along said respective adjustment surfaces to fix such positional adjustment; thereby enabling a standard positioned lamp and lamp holder assembly, and a base (22) having a standard receptacle to receive and retain a portion of the adapter and having contacts (24) structured and arranged for mechanical and electrical connection with (a) said lead wires of said lamp and (b) an exterior electrical connector to thereby enable connection of electrical power from said exterior connector to said lamp, said base being one of a straight base (204) and an angled base (22, 218), thereby providing a vehicle lamp base assembly wherein said straight base and said angled base may be interchanged with said lamp holder assembly during manufacture.

26. The lamp base assembly of claim 25 wherein said adapter component is a high temperature plastic and said base component is a lower temperature plastic.

* * * * *